US005797451A

United States Patent [19]

Grant

[11] Patent Number: 5,797,451

[45] Date of Patent: Aug. 25, 1998

[54] REFRIGERATION APPARATUS

[75] Inventor: Alexander Grant, Watten, Great Britain

[73] Assignee: Norfrost Limited, Caithness, Great Britain

[21] Appl. No.: 793,596

[22] PCT Filed: Aug. 30, 1995

[86] PCT No.: PCT/GB95/02035

§ 371 Date: Apr. 24, 1997

§ 102(e) Date: Apr. 24, 1997

[87] PCT Pub. No.: WO96/07064

PCT Pub. Date: Mar. 7, 1996

[30] Foreign Application Priority Data

Sep. 1, 1994 [GB] United Kingdom ..... 9417551
Sep. 16, 1994 [EP] European Pat. Off. ..... 94306784

[51] Int. Cl.[6] ..... F28F 1/22

[52] U.S. Cl. ..... 165/171; 165/DIG. 498

[58] Field of Search ..... 165/171, 183

[56] References Cited

U.S. PATENT DOCUMENTS 3,224,503 12/1965 Konanz ..... 165/171
4,071,934 2/1978 Zolman et al. ..... 165/171 X
5,398,752 3/1995 Abbot ..... 165/171

FOREIGN PATENT DOCUMENTS 121089 5/1966 Czechoslovakia ..... 165/171
228 036 A1 10/1985 German Dem. Rep. .
287 321 2/1991 German Dem. Rep. .
2 143 886 10/1972 Germany .
31 21 267 A1 12/1982 Germany .
40 21 250 A1 1/1991 Germany .

*Primary Examiner*—Allen J. Flanigan
*Attorney, Agent, or Firm*—Sixbey, Friedman, Leedom & Ferguson, P.C.; Gerald J. Ferguson, Jr.

[57] ABSTRACT

The invention relates to refrigeration apparatus such as freezers, refrigerators and bottle/can coolers/chillers. A condenser (5) is normally located on a rearmost side of a refrigeration apparatus. The condenser (5) comprises a pipe (10) for containing a refrigerant, one or more adjacent portions (15) of the pipe (10) being connected by a baffle (20, 25), characterised in that the baffle provides a plurality of wall portions, at least some wall portions (40, 45, 50, 55) being disposed in opposing directions relative to a plane extending between respective adjacent portions of the pipe.

8 Claims, 3 Drawing Sheets

REFRIGERATION APPARATUS

This invention relates to refrigeration apparatus such as freezers, refrigerators and bottle/can coolers/chillers. The invention particularly relates to an improved condenser for use in such apparatus.

Condensers (heat exchange devices) which remove heat from a refrigerant material and expel it to the atmosphere outwith the refrigeration apparatus are known. Condensers are normally located on a rearmost side of a refrigeration apparatus, and are therefore termed "back condensers".

Figure 1:
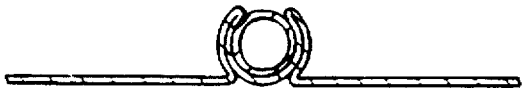
Figure 2:
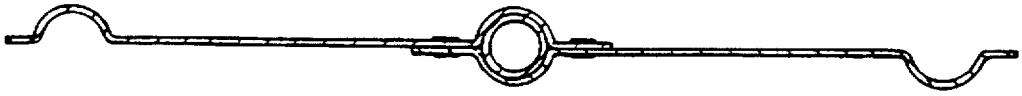
Figure 3:
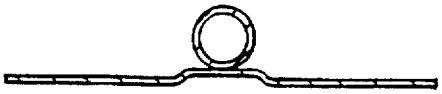

Known condenser designs are illustrated in FIGS. 1 to 3. These condensers comprise a condenser pipe having a plurality of substantially parallel spaced portions (lengths), adjacent portions being connected by a louvered steel plate. In FIG. 1 adjacent portions are connected by a steel plate, opposing elongate edges of which plate are crimped to respective adjacent portions. In FIG. 2 adjacent portions are connected by a steel plate, elongate edges of the plate being suitably shaped so as to, with an adjacent plate, enclose a portion therebetween, adjacent elongate edges of the plate and the adjacent plate being spotwelded together. In FIG. 3 all portions are connected by a single steel plate, each portion being welded onto the plate.

DE 3121267 (THERMAL-WERKE) discloses a condenser for refrigerators in the form of a serpent pipe having vertical pipe runs, which are joined to a heat conducting plate in order to extend the heat-conducting surface, whereby the plate is shaped so that it also extends the heat conducting surface, the plate providing horizontal cross-pieces arranged alternatively on opposite sides of the plane of the plate.

A number of problems have been found with prior art condensers. One problem is that of efficiency of heat transfer from the refrigerant material within the pipe to the atmosphere.

It is an object of the present invention to obviate or mitigate at least some of the aforementioned problems in the prior art.

According to a first aspect of the present invention there is provided a condenser for a refrigeration apparatus comprising a pipe for containing a refrigerant, one or more adjacent portions of the pipe being connected by a baffle, characterised in that the baffle provides opposing directions relative to a plane extending between respective adjacent portions of the pipe.

The adjacent portions of the pipe may be spaced substantially parallel one from another.

There may be provided two baffles for connecting the portions of the pipe.

Each baffle may comprise a plate formed so as to provide a plurality of recesses, the recesses being spaced so as to receive respective adjacent portions of the pipe.

Between and along adjacent recesses each baffle may provide a plurality of wall portions, as least some adjacent wall portions of each baffle being disposed in opposing_ directions relative to a plane extending between the respective adjacent portions of the pipe.

Wall portions of each of the two baffles may be in intimate contact with one another. The adjacent portions of the pipe may be spaced at around 31.75 mm centres.

According to a second aspect of the present invention there is provided a refrigeration apparatus including a condenser, the condenser comprising a pipe for containing a refrigerant, one or more adjacent portions of the pipe being connected by a baffle, characterised in that the baffle provides a plurality of wall portions, at least some wall portions being disposed in opposing directions relative to a plane extending between respective adjacent portions of the pipe.

The refrigeration apparatus may be, for example, a refrigerator, a freezer, or a bottle/can cooler/chiller, may be of the chest or front opening type, and may be for commercial or domestic use.

According to a third aspect of the present invention there is provided a condenser for a refrigeration apparatus comprising a pipe for containing a refrigerant, one or more adjacent portions of the pipe being connected by at least two baffles.

Between adjacent portions of the pipe each baffle may provide a plurality of wall portions, adjacent wall portions being disposed in opposing directions relative to a plane extending between the adjacent portions of the pipe.

According to a fourth aspect of the present invention there is provided a refrigeration apparatus including a condenser, the condenser comprising a pipe for containing a refrigerant, one or more adjacent portions of the pipe being connected by at least two baffles.

Figure 4:
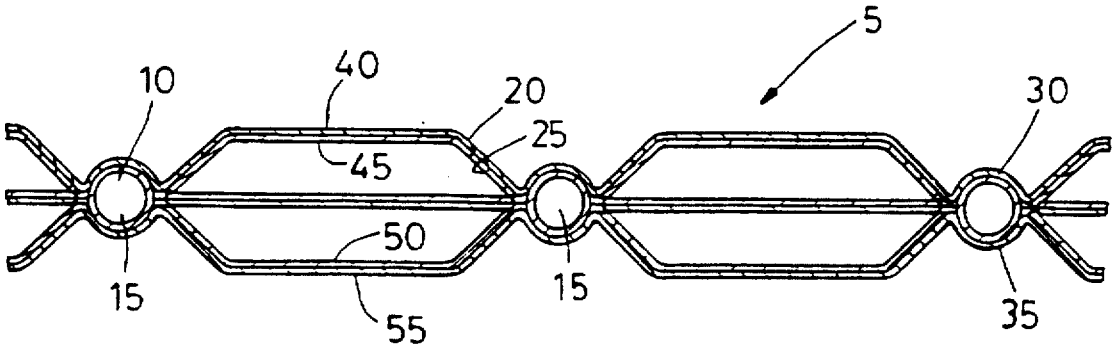
Figure 5:
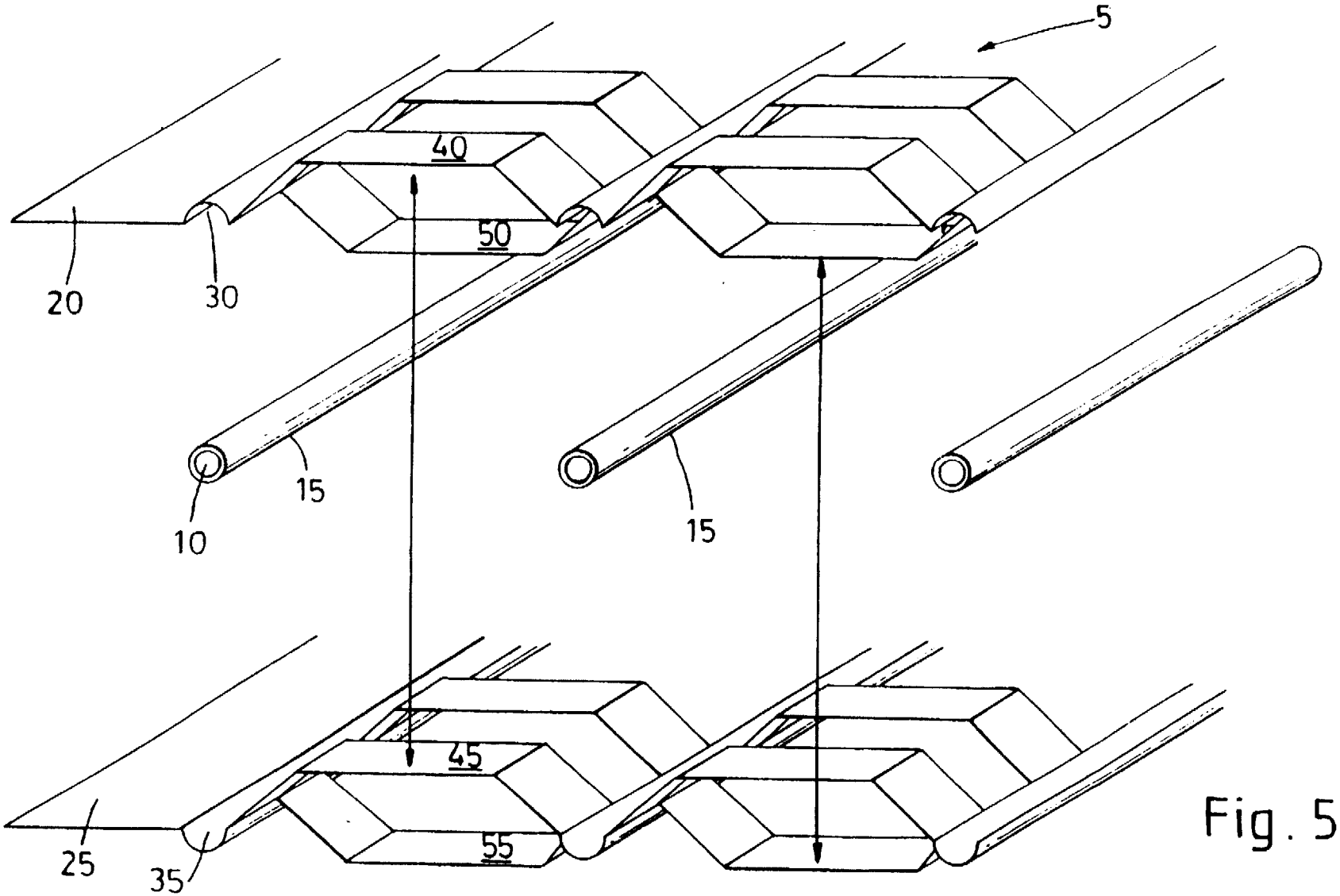

An embodiment of the present invention will now be described, by way of example only, with reference to the accompanying drawings, which are:

FIG. 1 a cross-sectional view from above of a portion of a first prior art condenser;

FIG. 2 a cross-sectional view from above of a portion of a second prior art condenser;

FIG. 3 a cross-sectional view from above of a portion of a third prior art condenser;

FIG. 4 a cross-sectional view from above of a condenser according to an embodiment of the present invention;

FIG. 5 a partial exploded perspective view from below and to the front of the condenser of FIG. 4; and FIG. 6 a view of the condenser of FIG. 4 mounted on the rear of a refrigeration apparatus.

Figure 6:
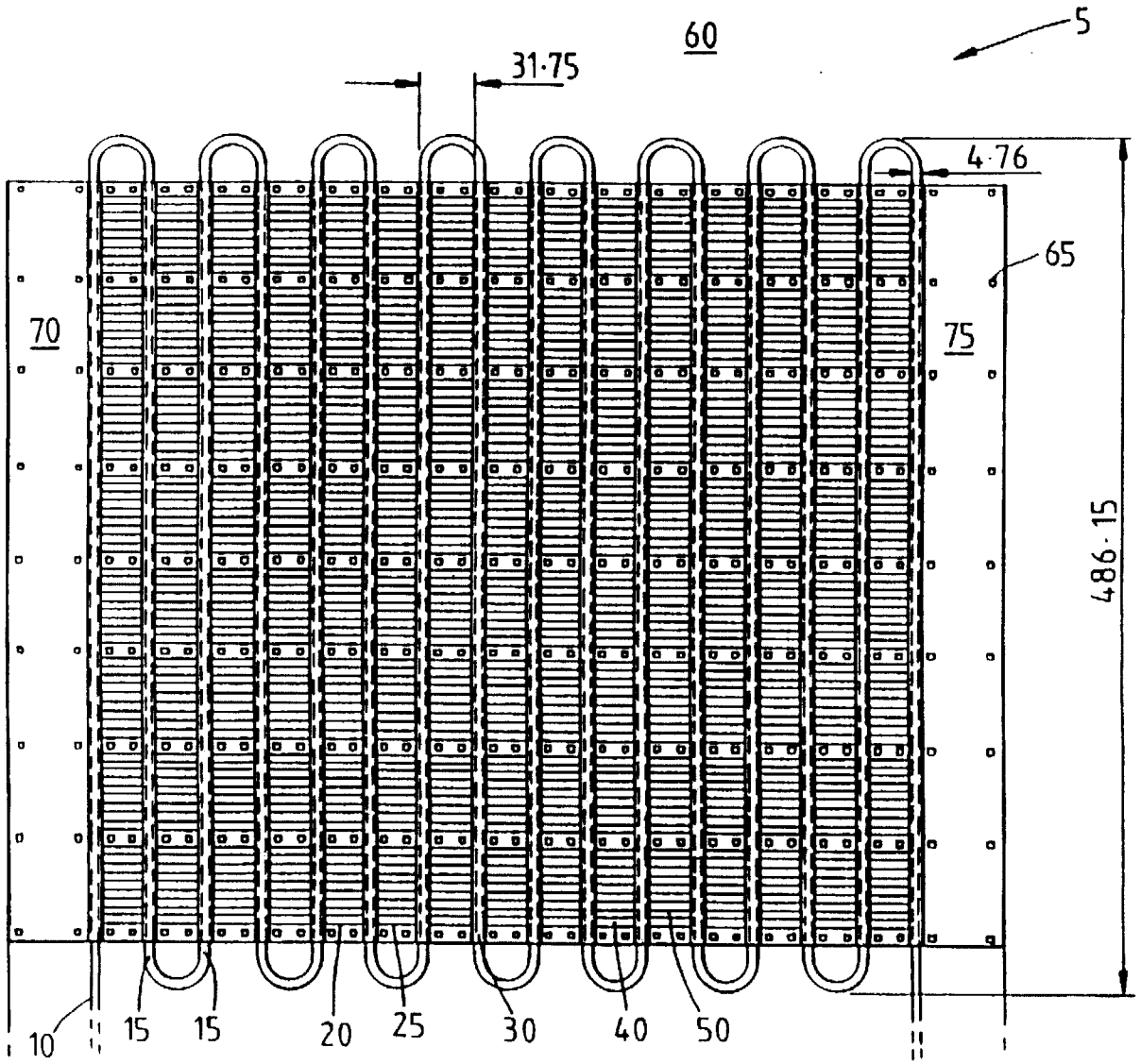

Referring to FIGS. 4 to 6, there is illustrated a condenser, generally designated 5, according to an embodiment of the present invention, for use in a refrigeration apparatus.

The condenser 5 comprises a pipe 10 for containing and transporting a refrigerant (not shown) therethrough. As can be seen most clearly from FIG. 6, the Dire 10 is shaped so as to provide a plurality of adjacent portions 15 spaced substantially parallel from one another.

The condenser 5 also provides first and second baffles 20, 25. Each baffle 20, 25 comprises a plate formed so as to provide a plurality of recesses 30, 35, the recesses 30, 35 being spaced so as to receive respective spaced portions 15 of the pipe 10.

Between and along adjacent recesses 30, 35 each baffle 20, 25, provides a plurality of walls 40, 45, 50, 55. For each baffle 20, 25, adjacent walls 40, 50 and 45, 55 are disposed in opposing directions relative to a plane extending between the recesses 30, 35 of the baffle 20, 25.

The condenser 5 may be formed as follows. Plane, unformed, baffles 20, 25 are provided and recesses 30, 35 initially formed therein by pressing. The baffles 20, 25 are then brought together so as to enclose the pipe 10 within the recesses 30, 35. The baffles 20, 25 are then tagged together by welds or the like. Subsequently the baffles 20, 25 are pressed so as to form walls 40, 45, 50, 55.

Alternatively, the condenser 5 may be formed by bringing together preformed baffles 20, 25 so as to enclose the pipe 10 within the recesses 30, 35. In doing this opposing surfaces of walls 40, 45 and walls 50, 55 are brought into proximity with one another. The baffles 20, 25 may again be retained together by welds or the like.

In a preferred embodiment of the invention: adjacent portions 15 of the pipe 10 are spaced at approximated 31.75 mm centres; the length of the portions 15 is approximately 486.15 mm; the baffles 20, 25 are made from steel plate approximately 0.28 mm thick; and the pipe 10 is made from steel pine of outer diameter 4.76 mm.

As shown in FIG. 6 the condenser 5 may be mounted in a conventional fashion to a rear side of a refrigerator cabinet 60 by means of screws 65 extending through flanged portions 70, 75 at first and second ends of the condenser 5.

In use, the condenser 5 forms part of a refrigeration apparatus operating in a conventional way, ie, extracting heat from refrigerant material passing through the pipe 10 and dumping such heat to atmosphere. However, the condenser 5 gives enhanced condensation. This effect is believed to be at least partially due to the "chimney effect" provided by the wall portions 40, 45, 50, 55 of the baffles 20, 25.

The embodiment of the invention hereinbefore described is given by way of example only and is not meant to limit the scope of the invention in any way. It should particularly be appreciated that although the disclosed embodiment has two baffles 20, 25 the "chimney effect" hereinbefore mentioned may be provided via a single baffle suitably shaped. It should further be appreciated that although the disclosed embodiment has adjacent wall portions 40, 45, 50, 55 of each baffle 20, 25 disposed in opposing directions relative to a plane extending between respective adjacent portions 15 of the pipe 10, only some of the wall portions require to be so disposed to provide the "chimney effect", and such wall portions need not be adjacent.

I claim:

1. A condenser (5) for a refrigeration apparatus comprising a pipe (10) for containing a refrigerant, one or more adjacent portions (15) of the pipe (10) being connected by baffle means, characterised in that the baffle means comprise first and second baffles (20, 25) located on respective first and second opposing sides of the pipe, each baffle providing a plurality of wall portions (40, 45, 50, 55), at least some wall portions of each baffle being disposed in opposing directions relative to a plane extending between respective adjacent portions of the pipe.

2. A condenser (5) as claimed in claim 1, wherein the adjacent portions (15) of the pipe (10) are spaced substantially parallel one from another.

3. A condenser (5) as claimed in any preceding claim, wherein each baffle (20, 25) comprises a plate formed so as to provide a plurality of recesses (30, 35), the recesses (30, 35) being spaced so as to receive respective adjacent portions (15) of the pipe (10).

4. A condenser (5) as claimed in claim 1, wherein wall portions (40, 45, 50, 55) of each of the baffles (20, 25) are in intimate contact with wall portions of the other baffle.

5. A condenser (5) as claimed in claim 1, wherein the adjacent portions (15) of the pipe (10) are spaced at around 31.75 mm between their centres.

6. A refrigeration apparatus including a condenser (5), the condenser comprising a pipe (10) for containing a refrigerant, one or more adjacent portions (15) of the pipe (10) being connected by baffle means, characterised in that the baffle means comprise first and second baffles (20, 25) located on respective first and second opposing sides of the pipe, each baffle providing a plurality of wall portions (40, 45, 50, 55), at least some wall portions of each baffle being disposed in opposing directions relative to a plane extending between respective adjacent portions of the pipe.

7. A refrigeration apparatus as claimed in claim 6, wherein the apparatus is one of a refrigerator, a freezer, or a bottle/can cooler/chiller.

8. A refrigeration apparatus as claimed in either of claims 6 or 7, wherein the apparatus is either a chest or front opening type.

* * * * *